US005460381A

United States Patent [19]

Smith et al.

[11] Patent Number: 5,460,381

[45] Date of Patent: Oct. 24, 1995

[54] PIRATE GAME APPARATUS

[76] Inventors: Raymond W. Smith, 37 Vine St., New Britain, Pa. 18901; David Wasserman, 191 Diane Ave., Horsham, Pa. 19044

[21] Appl. No.: 326,211

[22] Filed: Oct. 20, 1994

[51] Int. Cl.[6] ..... A63F 3/00

[52] U.S. Cl. ..... 273/238

[58] Field of Search ..... 273/237, 238, 273/242, 243, 258

[56] References Cited

U.S. PATENT DOCUMENTS

| | | | |
|---|---|---|---|
| 1,232,133 | 7/1917 | Warden | 273/238 |
| 2,766,988 | 10/1954 | Haumersen . | |
| 3,640,536 | 2/1972 | Godmer | 273/238 |
| 3,771,791 | 11/1973 | Nelson | 273/238 |
| 3,844,567 | 10/1974 | Marker | 273/254 |
| 4,021,044 | 5/1977 | Matsumoto . | |
| 4,300,770 | 11/1981 | Knetzger | 273/238 |
| 4,848,767 | 7/1989 | Correro | 273/238 X |
| 4,981,300 | 1/1991 | Winkler | 273/238 |
| 5,069,458 | 12/1991 | Washington | 273/238 |
| 5,188,368 | 2/1993 | Ryan | 273/237 |
| 5,215,311 | 6/1993 | Schuller | 273/238 X |
| 5,249,806 | 10/1993 | Nathanson | 273/241 |
| 5,251,904 | 10/1993 | Cruz | 273/238 X |

FOREIGN PATENT DOCUMENTS

| | | | |
|---|---|---|---|
| 2066087 | 7/1981 | United Kingdom | 273/238 |
| 9408672 | 4/1994 | WIPO | 273/238 |

*Primary Examiner*—William E. Stoll
*Attorney, Agent, or Firm*—Eric A. LaMorte

[57] ABSTRACT

A game apparatus wherein players move along a playing path and make various electrical interconnections along the way. At any one given time only one space on the playing field contains an open switch coupled to a noise generating device. If a player lands on the selected space and closes the switch, a noise will sound and the player gets to keep toy money laid out on the playing field. A selection control unit randomly changes the position of the open switch on the game board each time it is found. As a result, a player never knows whether or not he or she is moving toward or away from the open switch. The selection control unit also eliminates previously used spaces from the random selection process. As such, the players know that once a space has been used and the money for that space has been taken, that space will not be selected again.

14 Claims, 2 Drawing Sheets

PIRATE GAME APPARATUS

BACKGROUND OF THE INVENTION

1. Field of the Invention

The present invention relates to games such as board games, wherein points are accumulated by completing an electrical circuit that is built into the game board. More particularly, the present invention relates to a game where a target point on the game board is randomly selected after every successful turn. The player that lands upon the target point during his/her turn attempts to complete an electrical circuit, and if successful, advances in the game.

2. Prior Art Description

The prior art is replete with board games that rely upon chance in the playing of the game. In many games, the element of chance is created by the roll of dice, the spinning of a wheel or the selection of a card. A more entertaining form of chance can be created by randomly altering the characteristics of the game board upon which the game is played. By altering the characteristics of the game board, the game is literally never the same twice. This adds to the interest of the game and keeps players from quickly becoming bored from playing the game.

Since randomly changing the characteristics of a game board is a fairly complex task, few games require the players to actually physically manipulate the game board into different orientations. Rather, most games that have randomly changing board characteristics are electronic. The changing of the board is done electronically or physically through the use of electric motors. This prevents the players from having to change the game themselves, thereby promoting the ease of playing the game and the entertainment value it provides.

A common type of prior art game device that changes each time it is played is a game that uses electrical contacts beneath the playing surface of the game board. Such games use probes or pegs that extend through the game board and engage the electrical contacts below. By electronically or physically altering which contacts complete a circuit, the game can be changed each time it is played. Such prior art game devices are exemplified by U.S. Pat. No. 5,249,806 to Nathanson, entitled MINEFIELD GAME; U.S. Pat. No. 4,021,044 to Matsumoto entitled ELECTRICAL CIRCUIT BOARD GAME; U.S. Pat. No. 3,844,567 to Marker, entitled PROBE CHANCE DEVICE HAVING ELECTRICAL SIGNALLING READOUT; U.S. Pat. No. 2,766,988 to Haumersen, entitled CHANCE CONTROLLED ELECTRICAL GAME; and U.S. Pat. No. 1,232,133 to Warden, entitled GAME APPARATUS. A problem with many of these games is that the mechanisms for changing the contacts under the game board are highly complex. This makes the game difficult to manufacture and very expensive. Another common defect with such games is that they require a high degree of coordination in order to place the probes in the small holes on the game board. This makes such games unenjoyable and/or unplayable by many younger children.

Recognizing that many people, especially children, are incapable of inserting probes into narrow peg holes, games have been developed in the prior art that passively effect electrical contacts positioned below the game board. Many such prior art games use game pieces with magnets embedded within them. As the playing piece passes over a specific position on the board, the magnetic field from the magnet is used to effect a reed switch or similar contact disposed below the board. Such prior art games are exemplified by U.S. Pat. No. 4,300,770 by Knetzger, entitled ELECTRONIC BOARD GAME, U.S. Pat. No. 5,188,368 to Ryan, entitled ELECTRONIC GAME APPARATUS and U.S. Pat. No. 4,981,300 to Winkler, entitled SENSORY GAMES. A problem with such games is that in order for the magnetic game piece to effect the switch within the game board, the playing piece must be positioned exactly over the switch. This need for the exact placement of the playing piece requires coordination skills and concentration abilities not typically possessed by small children. Such games are therefore not meant to be played by younger children.

A need exists in the art for a game that changes each time it is played, is easy to operate, easy to play by a young child, and is inexpensive to manufacture. The present invention game apparatus meets these objectives in the form of a pirate adventure game. Although other games exist based on pirate adventures, such as U.S. Pat. No. 3,874,671 to Smith entitled GAME BOARD APPARATUS, no game in the prior art contains the unique elements of the present invention as described and claimed below.

SUMMARY OF THE INVENTION

The present invention is a game apparatus wherein players move along a playing path and make various electrical interconnections along the way. At any one given time only one space on the playing field contains an open switch coupled to a noise generating device. If a player lands on the selected space and closes the switch, a noise will sound and the player gets to keep toy money laid out on the playing field. A selection control unit randomly changes the position of the open switch on the game board each time it is found. As a result, a player never knows whether or not he or she is moving toward or away from the open switch. The selection control unit also eliminates previously used spaces from the random selection process. As such, the players know that once a space has been used and the toy money for that space has been taken, that space will not be selected again.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
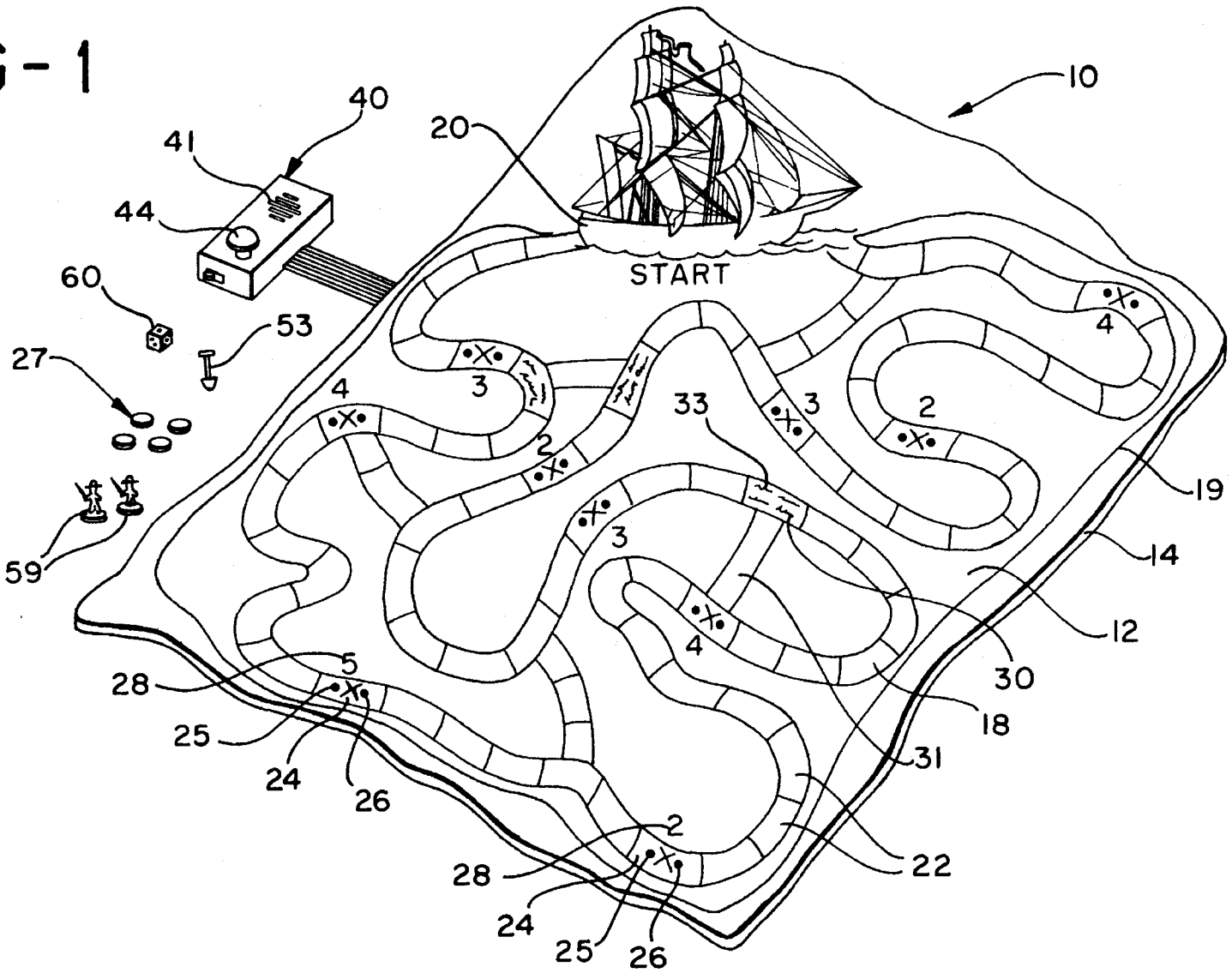
FIG. 1 is a perspective view of one preferred embodiment of the present invention game apparatus.

Referring to FIG. 1, there is shown one preferred embodiment of the present invention game apparatus 10. In the shown embodiment, the playing field indicia 12 is printed on a flexible piece of material 14. As such, the playing field indicia 12 can be easily set on a table or on the floor to enable younger children to play safely play with the game. It will be understood that although the playing field indicia 12 is preferably printed on a flexible piece of material, the playing field indicia 12 can also be printed on a conventional rigid game board or any other game surface known in the art.

As shown in FIG. 1, the playing field indicia 12 consists of a series of interconnecting paths 18 that originate from the indicia of a pirate's ship 20. The paths 18 travel along the image of an island 19 to further the preferred pirate motif of the game. The actual direction and shapes of the paths 18 are unimportant and they can have any configuration where a player would have a multitude of choices as to where to move his or her playing piece when traveling along the paths. The paths 18 are segmented into a plurality of playing spaces 22. Each playing space may be plain, colored or have some unique indicia printed thereupon for a purpose which will later be explained.

At various points along the paths 18 are treasure spaces 24 marked preferably with a large X. On each of the treasure spaces 24 are disposed two electrical contacts 25, 26. Adjacent to the treasure spaces 24 is a numerical value indication 28 indicative of how many coins 27 are to be placed at that location. In the shown embodiment, the treasure spaces 24 are each identified by large X. Other identifiers can also be used such as the image of a treasure chest or the like. The shown playing field indicia 12 has ten treasure spaces 24. Ten is an arbitrary number and any other greater or lesser number can be used.

A series of instruction spaces 30 are also found along the segmented paths 18. The instruction spaces 30 are associated with non-segmented paths 31 that join various sections of the segmented path 18, for a purpose which will later be described. The instruction spaces 30 set forth instructional text 33 used while playing the game.

A control unit 40 extends from the material playing field 14. Such an orientation is merely optional and it should be understood that the control unit 40 can be located on the material playing field 14 itself. The control unit 40 may have a plug (not shown) to accept 120 v A/C from a common receptacle wherein the A/C would be converted to a lower voltage D/C current for use in the game. However, in the preferred embodiment, the control unit 40 retains batteries (not shown) thereby providing a direct source of low voltage D/C current.

The control unit 40 randomly supplies an electrical potential to the two electrical contacts 25, 26 located at one of the multiple treasure spaces 24. At the same time the selected electrical contacts 25, 26 are made part of a circuit joined to a buzzer 41 within the control unit 40. When a selected pair of electrical contacts 25, 26 are shorted, the buzzer 41 in the control unit 40 sounds. The random selection of a pair of electrical contacts 25, 26 at one of the treasure spaces 24 is controlled by a large reset button 44 on the control unit 40. Each time the reset button 44 is depressed, the control unit 40 randomly selects one of the sets of electrical contacts 25, 26 so a player never knows which of the electrical contacts 25, 26 at which of the treasure spaces 24 are joined in a circuit with the buzzer 41.

Figure 2:
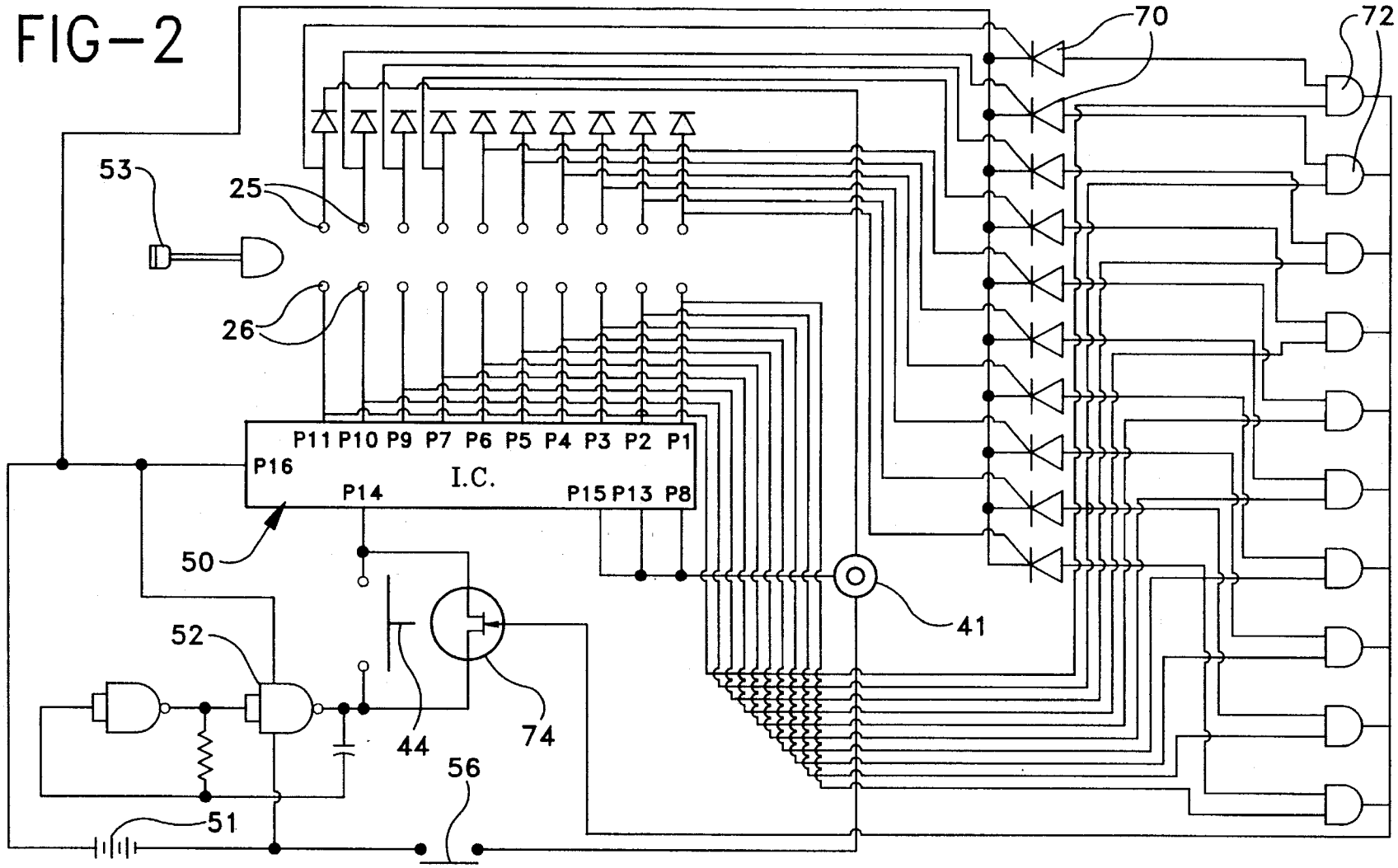
FIG. 2 is an electrical schematic showing the circuitry of the present invention game apparatus.

Referring now to FIG. 2, an electrical schematic is shown for the present invention game apparatus 10. In FIG. 2, the contacts 25, 26 of each of the ten treasure spaces are shown in a linear orientation. The various contacts 25, 26 separate leads from an integrated circuit 50 to a piezoelectric buzzer 41. A battery 51 is also provided to supply power to both the circuit and the piezoelectric buzzer 41. In the shown embodiment, the random selection of which of the ten sets of electrical contacts 25, 26 is part of the buzzer/battery circuit is done by a decade synchronous counter I.C. 50 such as a 4017IC chip manufactured by Texas Instruments. Pin 1 through pin 7 and pin 9 through pin 11 are joined to the negative biased contact 25 in each of the ten sets of contacts, respectively. The appropriate electrical potential is coupled to pin 16 of the decade synchronous counter 50 while a double two-input NAND gate circuit 52 is joined to pin 14. The reset button 44 disrupts the electrical connection of the double two-input NAND gate circuit 52 with pin 14 of the decade synchronous counter 50. Each time the reset button 44 is depressed, the decade synchronous counter 50 randomly enables only one of the ten contact leads 26.

As will be later explained, players who land on a treasure space 24 attempts to short the two contacts 25, 26 (FIG. 1) located at that space with a conductive element such as the shown toy shovel 53. If the player shorts one of the nine unselected contacts, nothing happens. However, if by chance a player lands on one of the set of contacts selected by the decade synchronous counter 50, then a circuit is complete and the piezoelectric buzzer 41 will sound. It will be understood by a person skilled in the art that if the piezoelectric buzzer 41 requires more current than passes through the decade synchronous counter 50, the buzzer 41 can be replaced by a switch in the circuit that separately joins the buzzer to the battery 51. The use of a buzzer is merely exemplary and any noise generating device may be used in its place. In an alternative embodiment, the buzzer may be replaced by a voice synthesizer that creates a short audible message. Such a message preferably promotes the pirate motif and may be instructional thereby helping in the play of the game. For instance, the message might say, "Ahoy mates! Take yea treasure", in the situation where the rules state a player should take the toy coins from the playing field. It should also be understood that the ten sets of contacts 25, 26 can be replaced by a push button switch, reed switch or any other open contact capable of being closed by a player.

An ON/OFF switch 56 may be included in the circuit between the battery 51 and the piezoelectric buzzer 41. The switch 56 can be used to disable the entire circuit when the game is not in use.

In the preferred embodiment of the game, it is desired that once a player lands on one of the ten treasure spaces that, by chance, has also been randomly selected by the decade synchronous counter 50 so that the buzzer sounds, that space is enabled and can be no longer randomly selected by the decade synchronous counter 50. In FIG. 2 it can be seen that ten silicon controlled rectifiers (SCR's) 70 are provided, wherein the gates of each of the SCR's 70 are coupled to the negative biased contacts 25 from each of the ten sets of contacts 25, 26 on the game board. The anode of each of the ten SCR's 70 is coupled to one of ten AND gates 72. The opposite input lead of each of the AND gate 72 is coupled to the corresponding positive biased contact 26 of each of the ten sets of contacts 25, 26 on the game board. The output lead of each of the ten AND gates is coupled to a N-JFET transistor 74 that is capable of shorting the reset button 44. When the game is started, all the SCR's are "OFF". If a person successfully shorts a pair of contacts 25, 26 and sounds the buzzer 41, the associated SCR 70 is triggered "ON" and sends an "ON" signal to the corresponding AND gate 72. For the purposed of this description, the successful completion of the circuit and the triggering of the SCR 70 means that that set of contacts 25, 26 has been "USED". When the player presses the reset button 44, the decade synchronous counter 50 randomly selects one of the ten sets of contacts 25, 26. If the decade synchronous counter 50 just happens to select one of the "USED" contacts, a second "ON" signal is sent to the opposite input gate of the corresponding AND gate 72. Since the AND gate is receiving two "ON" signals, an "ON" signal is propagated through the AND gate 72 to the transistor 74. The transistor 74 then shorts the reset button 44 and causes the decade synchronous counter 50 to select another set of contacts. As a result, once a set of contacts 25, 26 has been "USED", that set can not be used again until all ten sets of contacts have been used.

Returning to FIG. 1, the method of playing the game can now be described. The game is set for play by taking the toy coins 27 and placing the appropriate number of coins on the treasure spaces 24. Each player then selects a playing piece 59, preferably shaped as a pirate, and places that playing piece on the pirate ship 20 printed as part of the playing field indicia 12. After a determination has been made as to who goes first, a player rolls the dice 60 and moves his/her playing piece the appropriate number of spaces along one of segmented paths 18.

If a player lands upon or crosses one of the treasure spaces 24, he or she may take the toy shovel 53 and touch it to the two electrical contacts 25, 26 at that space, in a fashion that mimics digging for treasure. Landing exactly on one of the treasure spaces 24 is not required in order to make the game more fun and easier to play for younger children. If the piezoelectric buzzer 41 sounds when the shovel 53 contacts the electrical contacts 25, 26, it shows that the player has landed on the treasure space randomly selected by the control unit 40. The player hearing the buzzer 41 is then allowed to take the gold coins at that treasure space 24. Once all the gold coins 27 have been removed from the game field, the game is over. The Player with the most coins wins the game.

The segmented paths 18 contain instruction spaces 30 proximate unsegmented paths 31 that join together unassociated segments of the primary segmented path 18. If a player lands upon one of the instruction spaces, he/she must follow those instructions. The instructions are preferably written in the pirate motif. Many times those instructions enable the player to move his/her playing piece across the unsegmented path 31. For example, if a player lands on one of the information spaces 30 that read green slippery stones, the player falls into the river (i.e. the unsegmented path) and gets carried down the river to another space where he/she starts their next turn.

Although the above described embodiment of the invention sets forth the best mode of the invention as derived by the inventor, it will be understood that a person skilled in the art of electronic game boards could make modifications and variations to the described designs by utilizing functionally equivalent components, varying proportions and/or creating alternate configurations. All such modifications and alternate design choices are intended to be covered by the scope of this application as defined by the appended claims.

What is claimed is:

1. A game, comprising:

a playing surface having at least one segmented path disposed thereon, wherein said segmented path includes a plurality of target spaces;

a plurality of open switches, wherein an open switch is disposed proximate each of said plurality of target spaces;

selecting means for randomly selecting and coupling one of said open switches to a circuit including a power source and an electric noise generating device, wherein the open switch prevents the flow of electricity between said power source and said electric noise generating device;

means for selectively closing the open switch at one of said plurality of target spaces when a playing piece lands thereupon during the course of the game; and means for eliminating one of said open switches previously selected by said selecting means from the choices of said open switches available to be selected by said selecting means.

2. The game according to claim 1, wherein each of said plurality of open switches includes two contacts exposed on said playing surface.

3. The game according to claim 2, wherein said means for selectively closing the open switch is an electrically conductive game piece.

4. The game according to claim 1, further including game pieces to be advanced along said at least one segmented path by at least one player.

5. The game according to claim 4, further including a means for randomly generating a number corresponding to how far along the segmented path a game piece will move.

6. The game according to claim 1, wherein said playing surface is a flexible sheet of material.

7. A method of playing a game, comprising the steps of:

providing a playing surface having at least one segmented path disposed thereon, and a plurality of open switching means disposed at target spaces contained within said at least one segmented path;

randomly coupling the open switching means at one of said target spaces to a circuit containing a noise generating device and a power source, wherein said open switching means disrupts the flow of current between said power source and said noise generating means;

advancing playing pieces along said segmented path until a playing piece lands upon a selected one of said target spaces; and closing said open switching means at the selected target space landed upon, wherein the player can ascertain whether the selected target space was the target space which contained the open switching means randomly coupled to said power source and said noise generating device; and preventing a target space from being randomly coupled to said power source and said noise generating device more than once in a game.

8. The method according to claim 7, further including collecting toy coins at said target spaces when a player successfully joins said power source to said noise generating means.

9. The method according to claim 7, wherein said step of closing said open switching means includes shorting two electrical contacts with a conductive playing piece.

10. The method according to claim 7, wherein said step of randomly coupling the open switching means at one of said target spaces to a circuit containing a noise generating device and a power source includes pushing a reset button on an electronic control that automatically selects one of said open switching means at one of said target spaces.

11. A game, comprising:

a playing surface having at least one segmented path disposed thereon, wherein said segmented path includes a plurality of target spaces;

a plurality of open switches, wherein an open switch is disposed proximate each of said plurality of target spaces;

a controller having a reset button associated therewith, wherein said controller randomly selects and couples only one of said open switches to a circuit including a power source and an electric noise generating device each time said reset button is engaged, and the open switch selected by said controller prevents the flow of electricity between said power source and said electric noise generating device; and means for selectively closing the open switch at one of said plurality of target spaces when a playing piece lands thereupon during the course of the game.

12. The game according to claim 11, further including a means for eliminating one of said open switches previously selected by said controller from the choices of said open switches available to be selected by said controller.

13. The game according to claim 11, wherein each of said plurality of open switches includes two contacts exposed on said playing surface.

14. The game according to claim 11, wherein said means for selectively closing the open switch is an electrically conductive game piece.

* * * * *